US007350543B2

(12) United States Patent
Crittenden

(10) Patent No.: US 7,350,543 B2
(45) Date of Patent: Apr. 1, 2008

(54) REDUCED FORCE SEALLESS CONNECTION MECHANISM

(75) Inventor: David E. Crittenden, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 96 days.

(21) Appl. No.: 11/382,437

(22) Filed: May 9, 2006

(65) Prior Publication Data

US 2007/0261754 A1 Nov. 15, 2007

(51) Int. Cl.

| | |
|---|---|
| ***B21F 9/02*** | (2006.01) |
| ***A01F 15/14*** | (2006.01) |
| ***B65B 13/02*** | (2006.01) |
| ***B65B 11/00*** | (2006.01) |
| ***B65B 67/08*** | (2006.01) |

(52) U.S. Cl. ..... 140/93.2; 100/33 R; 53/399; 53/582; 53/592

(58) Field of Classification Search ..... 140/93.2, 140/102.5, 123.5, 123.6, 150–154; 100/29, 100/30, 33 R, 33 PB; 53/399, 580, 582, 53/589, 592

See application file for complete search history.

(56) References Cited

U.S. PATENT DOCUMENTS 2,549,626 A * 4/1951 Mosey ..... 140/93.2
3,152,621 A * 10/1964 Meier ..... 140/123.6
4,825,512 A 5/1989 Tremper et al.
5,097,874 A 3/1992 Bobren
5,694,984 A 12/1997 Cheung
5,848,621 A 12/1998 Cheung
6,554,030 B2 4/2003 Cheung et al.

* cited by examiner

*Primary Examiner*—Ed Tolan
*Assistant Examiner*—Teresa M Bonk
(74) *Attorney, Agent, or Firm*—Mark W. Croll; Donald J. Breh; Levenfeld Pearlstein, LLC

(57) ABSTRACT

A reduced force sealless connection mechanism is used in a strapping machine for forming a sealless connection of strapping material overlapped onto itself. The mechanism includes an upper and a lower punch support. The upper punch support includes two punches for engaging the strapping material. The lower punch support includes one punch. The upper punch support incorporates a stepped design such that one of the two punches mounted to the upper punch support is at a different height than the other punch mounted to the upper punch support. Each of the punches includes a plurality of punching heads. At least one punching head of each of the plurality of punching heads is shorter than the other punching heads. A multi-step punching sequence is therefore created such that no more than two slits of any of the joints of the sealless connection are simultaneously punched during creation of the sealless connection. Thus, the operator force required to actuate the mechanism is reduced and wear on the strapping machine components is decreased.

17 Claims, 2 Drawing Sheets

REDUCED FORCE SEALLESS CONNECTION MECHANISM

BACKGROUND OF THE INVENTION

The present invention pertains to a sealless connection mechanism for joining strapping materials. In particular, the present invention pertains to a reduced force sealless connection mechanism for use in a strapping machine to create a sealless connection between overlapping strapping materials.

Strapping machines (or "strappers") are well known in the art. These machines are used for strapping articles, e.g., a load, together with strapping material. Strapping material is offered in a variety of sizes and materials and is generally stored on a roll. Conventional strapping materials include steel and plastic.

Typically, a free end of strapping material is passed around the load until there is an overlap between the free end and the strapping material still connected to the roll. The overlapping portion of strapping material is placed between jaws of a strapping machine and the free end of the strapping material is fixed in place by a gripper portion of the machine. After the strapping material is fixed, the material is tightened or tensioned around the load to a desired tension. This is accomplished by operating a feed wheel, a windlass or similar mechanism to pull back, or tension, the strapping material.

A typical strapper includes sealing heads for sealing the free end of the strapping material onto itself, around the load. Typically, in manual (i.e., hand-operated) strappers, a handle is rotated which applies a force to cause a punch or sealing head to press down against the strap to seal the strap to itself. After the strapping material is sealed, the strapping material still connected to the roll is cut by a cutter, which is a portion of the strapper. This completes one strapping operation. This type of seal, known as a "sealless" connection, is effected by sealing the strap to itself, and differs form those strappers that position a separate piece of material around the tensioned strap.

Typically, such a sealless connection employs one or two longitudinal rows of interlocking joints (or "keys"), each comprising a plurality of shoulders, which are defined by Z-shaped or other slits in the overlapped strapping material segments. The keys are adapted to interlock with each other when the overlapped strapping material segments are released under a tensile load. The overlapped strapping material segments shift longitudinally with respect to each other in a locking direction.

An "anti-reverse" locking means also may be provided for the sealless strap connection, such locking means designed to prevent the overlapped, connected strapping material segments from shifting longitudinally to unlock the interlocking shoulders after creating the sealless connection. One such sealless connection having an "anti-reverse" locking mechanism is disclosed in U.S. Pat. No. 4,825,512 for a "Sealless Strap Connection," commonly owned with the present application, and incorporated herein by reference.

Regardless of the particular sealless connection configuration, considerable force is required to form the keys in the strapping material and to cut the material. As such, an operator may fatigue from repeatedly applying force while forming the sealless connection, and the strapping machine components may wear, and possibly fail, prematurely.

To help reduce operator fatigue and component wear, and to lessen the force required to operate the strapper, various strapper designs have been developed. One known type of prior strapper uses a cammed arrangement with differently configured cam lobes to sequentially move the sealing heads into engagement with the strap. Although this reduces the amount of force necessary to effect a seal, the mechanical movement (and thus the components required), is complex and results in increased maintenance to the strapper. Since many such strappers are used "in the field" increased maintenance typically results in a tool that has limited usefulness.

Other strapper designs, however, have taken a different approach to lessening the operator force required to create the sealless connection. For example, the prior art includes a strapper having a progressive punch design, such as that disclosed in U.S. Pat. No. 6,554,030 for a "Progressive Punch," commonly owned with the present application, and incorporated herein by reference. In this device, a progressive punch is used in a strapping machine for positioning and sealing an associated strap material around a load.

The progressive punch is positioned in a strapper jaw assembly that includes a movable punch support and a fixed punch support configured to receive the overlapping strapping material therebetween. The movable and fixed supports each include at least one punch having at least two punching heads. The heights of the punching heads are different from one another so that the punching heads progressively engage the strap, with each punching head initially engaging the strapping material at a different time from the others.

Under such a design, the amount of operator force required to create the seal is reduced by controlling the sequence of the punching heads such that less than all of the punching heads are punching the strapping material at a given time. For example, in a sealless connection design comprising longitudinal rows of three joints (a "three key" joint), as is well known in the prior art, a two-step punching sequence is created when using three punches (two upper punches and single lower punch, each with three punching heads). In the first step, the punching heads simultaneously punch the inner and outer slits of the first and last joints. In the second step, the punching heads simultaneously punch the inner and outer slits of the middle joint.

While this design is an improvement over the prior art and does serve to reduce the force required to create the sealless connection, it does not fully optimize the punching sequence to further minimize the required operator force and to further reduce equipment wear. To with, in the first step, the punching heads simultaneously punch four slits of two joints. It would be advantageous to further reduce the number of simultaneous punches such that no more than two slits of any of the joints are simultaneously punched. The force required to create the sealless connection would then be proportionately reduced.

Accordingly, there is a need for an improved progressive punch design that permits a sufficiently strong sealless connection to be formed with a smaller actuating force than currently required by prior art devices. Desirably, such a progressive punch design includes a plurality of punching heads that are configured in such a manner that no more than two slits of any of the joints are simultaneously punched in the strapping material. Most desirably, such a configuration is achieved through a combination of punching heads having different heights, along with a stepped punch support plate designed to further sequence the engagement of the punches with the strapping material.

BRIEF SUMMARY OF THE INVENTION

A reduced force sealless connection mechanism is used in a strapping machine for positioning a strap material around a load and for forming a sealless connection of strapping material overlapped onto itself. An exemplary strapping machine includes a strapping machine body having a jaw assembly that includes an upper and a lower punch support. The upper and lower punch supports are configured to receive the strapping material therebetween.

The upper punch support includes two punches (an upper inside punch and an upper outside punch) for engaging the strapping material. The lower punch support includes one punch (a lower center punch). The lower center punch is disposed between the upper inside punch and the upper outside punch but with sufficient overlap with the upper inside punch and the upper outside punch so as to interactively couple with the upper inside punch and the upper outside punch upon actuation of the connection mechanism.

The upper punch support incorporates a stepped design such that one of the two punches mounted to the upper punch support is at a different height than the other punch mounted to the upper punch support. In the preferred embodiment of the present invention, the upper inside punch is at a lower height, with respect to the longitudinal plane of the strapping material, than the upper outside punch.

Each of the punches includes at least two punching heads, and, in the preferred embodiment, each of the punches includes three punching heads. Each punching head includes a base, for attachment to the respective punch support, and a cutting edge, for engaging the strapping material to create the joints upon actuation of the connection mechanism. Additionally, in the preferred embodiment, the middle punching head of each of the three punches is shorter in height, relative to the longitudinal plane of the strapping material, than each of the other punching heads. The punches and punching heads are configured such that the punching heads engage the strapping material in a controlled, sequenced fashion.

The upper punch support is movable toward and away from the lower punch support, which is fixed. When an actuating force is applied to the connection mechanism, the upper punch support moves towards the lower punch support, causing the upper punches on the upper punch support to engage the upper surface of the overlapping strapping material and the lower punches on the lower punch support to correspondingly engage the lower surface of the overlapping strapping material.

In the preferred embodiment, a four-step punching sequence is created by the design of the connection mechanism of the present invention. In the first step, the first and last punching heads of the upper inside punch and the first and last punching heads of the lower center punch cooperate to form the inner slits of the first and last joints. In the second step, the first and last punching heads of the upper outside punch and the first and last punching heads of the lower center punch cooperate to form the outer slits of the first and last joints. In the third step, the middle punching head of the upper inside punch and the middle punching head of the lower center punch cooperate to form the inner slit of the middle joint. And, in the fourth step, the middle punching head of the upper outside punch and the middle punching head of the lower center punch cooperate to form the outer slit of the middle joint.

Under such a configuration, no more than two slits of any of the joints are simultaneously punched during creation of the sealless connection. This reduces the operator force required to actuate the mechanism and decreases wear on the strapper components.

Other features and advantages of the present invention will be apparent from the following detailed description, the accompanying drawings, and the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated. It should be farther understood that the title of this section of this specification, namely, "Detailed Description Of The Invention," relates to a requirement of the United States Patent Office, and does not imply, nor should be inferred to limit the subject matter disclosed herein.

Figure 1:
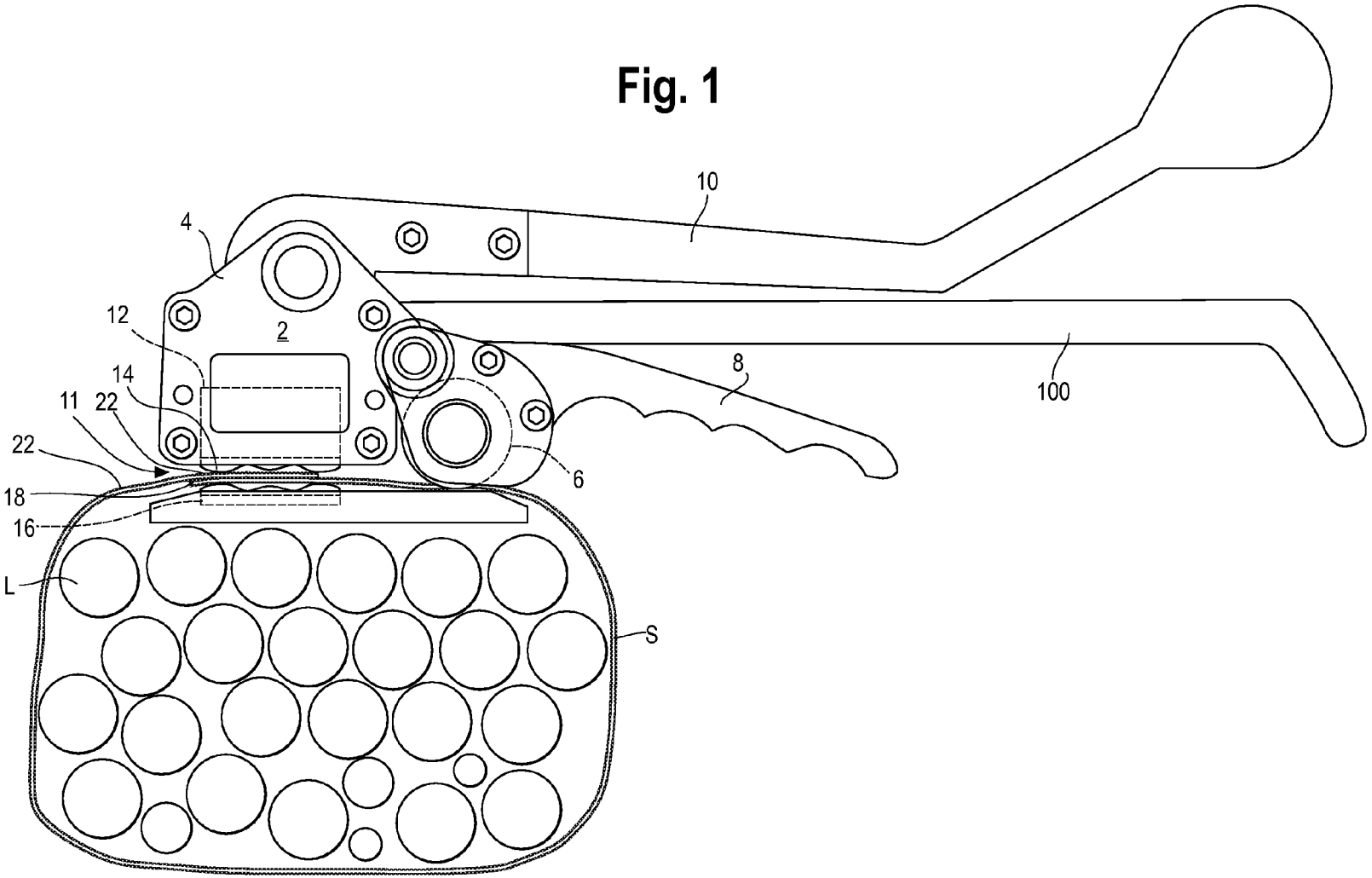
FIG. 1 illustrates an exemplary prior art strapping machine utilizing the sealless connection mechanism of the present invention.

It will be appreciated that the reduced force sealless connection mechanism of the present invention may be utilized by a variety of strapping machines or tools (also referred to as "strappers") such as the exemplary strapper 2 as illustrated in FIG. 1. It may be used with manual, pneumatic or other powered strappers without departing from the scope of this disclosure.

The strapper 2 includes a strapping machine body 4, a gripper (not shown), a feed wheel 6, and accompanying feed lever 8. The strapper 2 further includes a cutter (not shown), an tensioning lever 10, a jaw assembly 11, and a sealing handle 100. The jaw assembly 11 includes an upper punch support 12 and a lower punch support 16. Those skilled in the art will recognize and appreciate the various strapping machines that may include different embodiments of grippers, feed wheels and/or accompanying levers, handles and cutters, or other structures used to grip the strapping material, tension the strapping material around a load, seal the strapping material and cut the strapping material.

Figure 2:
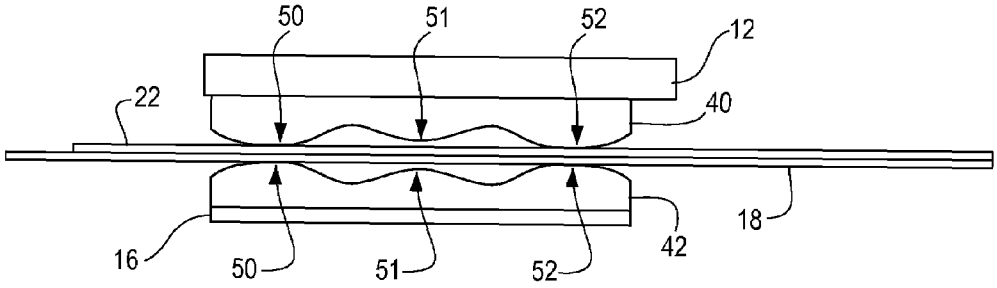
FIG. 2 is a side view of the reduced force sealless connection mechanism of the present invention.
Figure 3:
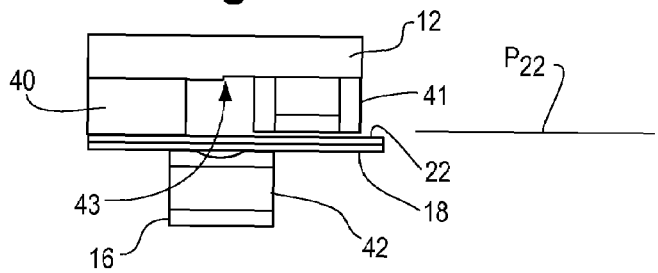
FIG. 3 is a front view of the reduced force sealless connection mechanism of the present invention.

Referring now to FIGS. 2-3, the upper punch support 12 includes two punches, an upper inside punch 40 and an upper outside punch 41 for engaging the strapping material. The lower punch support 16 includes one punch, a lower center punch 42. The lower center punch 42 is disposed between the upper inside punch 40 and the upper outside punch 41 but with sufficient overlap with the upper inside punch 40 and the upper outside punch 41 so as to interactively couple with the upper inside punch 40 and the upper outside punch 41, and engage overlapping strapping material top surface 22 and bottom surface 18, upon actuation of the connection mechanism.

Figure 4:
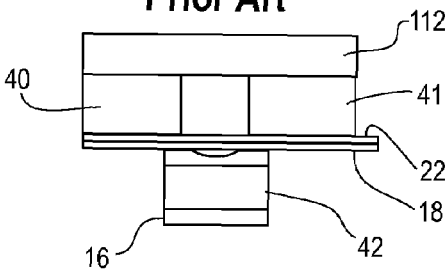
Fig. 4 Prior Art
FIG. 4 is a front view of a prior art sealless connection mechanism.

The upper punch support 12 incorporates a step 43 such that the upper inside punch 40 is at a lower height, with respect to the longitudinal plane $P_{22}$ of the overlapping strapping material top surface 22, than the upper outside punch 41. This can more clearly be seen by comparing the reduced force sealless connection mechanism of the present invention, to a prior art sealless connection mechanism as shown in FIG. 4. As shown in FIG. 4 prior art upper punch support 112 does not incorporate a step, and upper inside punch 40 is at the same height, with respect to the longitudinal plane $P_{22}$ of the overlapping strapping material top surface 22, as the upper outside punch 41. It will be appreciated, however, that, without departing from the scope of this disclosure, step 43 could be reversed such that the upper outside punch 41 is at a lower height, with respect to the longitudinal plane of the overlapping strapping material top surface 22, than the upper inside punch 40.

As shown in FIG. 2, in the preferred embodiment of the present invention, each of the punches (upper inside punch 40, upper outside punch 41 (not shown), and lower center punch 42) includes three punching heads: a first punching head 50, a middle punching head 51, and a last punching head 52. It will be appreciated, however, the number of punching heads may vary depending upon the number of joints in the desired sealless connection. Such variation in the number of punching heads is included within the scope of this invention.

The design of the punching heads is well known in the prior art. Each punching head includes a base, for attachment to the respective punch support, and an arcuate cutting edge, for engaging the overlapping strapping material top surface 22 and bottom surface 18, upon actuation of the connection mechanism to create the joint slits. In the illustrated embodiment, the each first punching head 50, each middle punching head 51, and each last punching head 52 are integral (e.g., formed as part of and machined together) with one another, such that their respective bases are a unitary element and their cutting edges are contiguous with one another. However, it will be appreciated that the reduced force sealless connection mechanism of the present device may be used with any number of different punching head designs without departing from the scope of this disclosure.

As further shown in FIG. 2, in the preferred embodiment of the present invention, the middle punching head 51 of each of the three punches (upper inside punch 40, upper outside punch 41 (not shown), and lower center punch 42) is shorter in height, relative to the longitudinal plane of the overlapping strapping material top surface 22, than each first punching head 50 and each last punching head 52. It therefore will be appreciated that the upper inside punch 40, upper outside punch 41 (FIG. 3), and lower center punch 42, and each first punching head 50, middle punching head 51, and last punching head 52, are configured such that each first punching head 50, middle punching head 51, and last punching head 52 engages the strapping material in a controlled, sequenced fashion, as further discussed below.

It is to be understood that although the preferred embodiment of the present invention as illustrated in FIG. 2 shows three punching heads (first punching head 50, middle punching head 51, and last punching head 52), each being linearly spaced with respect to the other, those skilled in the art will recognize that other punching head configurations fall within the scope and spirit of the present invention. For example, incorporating two or more punching heads onto the punches (upper inside punch 40, upper outside punch 41 (not shown), and lower center punch 42) is within the scope and spirit of the present invention. It should be further understood that although the preferred embodiment of the present invention has the middle punching head 52 at a lower height than the first punching head 50 and the last punching head 52, the order of these heights can be varied and arranged in any manner, again, within the scope and spirit of the present invention.

As shown in FIGS. 1-3, the upper punch support 12 is movable toward and away from the lower punch support 16, which is fixed. When an actuating force is applied to the connection mechanism through sealing handle 100, the upper punch support 12 moves towards the lower punch support 16, causing upper inside punch 40 and upper outside punch 41 on upper punch support 16 to engage the overlapping strapping material top surface 22 and the lower center punch 42 on the lower punch support 16 to correspondingly engage the overlapping strapping material bottom surface 18. The order of engagement of each of the punching heads (first punching head 50, middle punching head 51, and last punching head 52) of each of the punches (upper inside punch 40, upper outside punch 41, and lower center punch 42) is governed by a combination of the height differential of the upper inside punch 40 and upper outside punch 41, as created by step 43, and the height differential of the first and last punching heads, 50 and 52, respectively, and the middle punching head 51.

In use, as shown in FIG. 1, strapping material (S), which can be stored on a roll, is passed around the load L and is fed into the jaws 11, between the upper punch support 12 and lower punch support 16. During loading of strapping material (S), feed lever 8 is actuated to lift the feed wheel 6 away from the gripper and to permit strapping material (S) to be loaded therebetween. The strapping material (S) is overlapped upon itself to create an overlapping strapping material top surface 22 and an overlapping strapping material bottom surface 18. After strapping material (S) is loaded into strapper 2, feed lever 8 is released thereby securing strapping material (S) between feed wheel 6 and the gripper (not shown).

Once strapping material (S) is loaded, tensioning lever 10 is actuated, alternating between a forward and rearward direction, which in turn rotates a ratchet wheel (not shown) in line with feed wheel 6. Repeated actuation of tensioning lever 10 therefore acts to tighten the strap around load L. After tightening, strapping material (S) then is sealed to itself, as further detailed below, and is cut from the roll by the cutter (not shown). Strapper 2 then is removed from the sealed strapping material (S) by actuating feed lever 8 to lift the feed wheel 6 away from the gripper, thereby allowing strapper 2 to be disengaged.

After strapping material (S) has been tightened by the actuation of tensioning lever 10, strapping material (S) is sealed by forward actuation of sealing handle 100. When the operator actuates sealing handle 100 in a forward direction, the upper punch support 12 moves towards the lower punch support 16, causing upper inside punch 40 and upper outside punch 41 on upper punch support 16 to engage the overlapping strapping material top surface 22 and the lower center punch 42 on the lower punch support 16 to correspondingly engage the overlapping strapping material bottom surface 18. This causes the punching heads 50, 51, and 52, which are attached to the punches 40, 41, and 42, to punch the overlapping strapping material top surface 22 and the overlapping strapping material bottom surface 18 to effect a seal.

Figure 5:
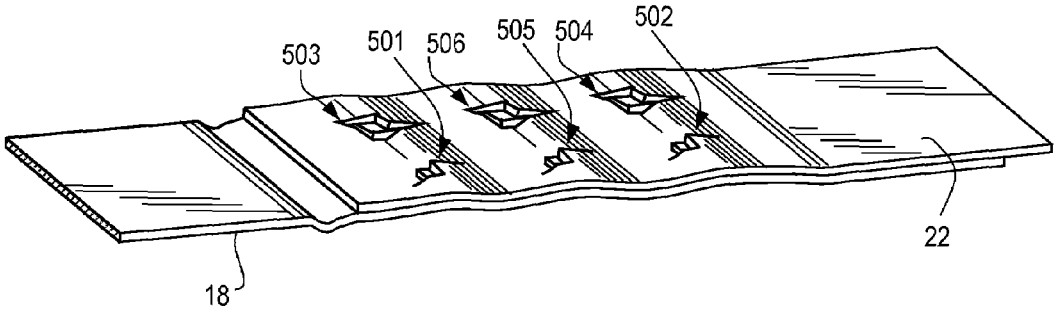
FIG. 5 is a perspective view of a sealless connection of the type created using the reduced force sealless connection mechanism of the present invention.

Specifically, in the preferred embodiment, a four-step punching sequence is created by combination of the height differential of the upper inside punch 40 and upper outside punch 41, as created by step 43, and the height differential of the first and last punching heads, 50 and 52, respectively, and the middle punching head 51. FIG. 5, displays an exemplary sealless connection as created by the reduced force sealless connection mechanism of the present invention.

In the first step, the first punching head 50 and last punching head 52 of the upper inside punch 40 and the first punching head 50 and last punching head 52 of the lower center punch 42 cooperate to form the inner slit 501 of the first joint and the inner slit 502 of the last joint, respectively. In the second step, the first punching head 50 and the last punching head 52 of the upper outside punch 41 and the first punching head 50 and the last punching head 52 of the lower center punch 42 cooperate to form the outer slit 503 of the first joint and the outer slit 504 of the last joint, respectively. In the third step, the middle punching head 51 of the upper inside punch 40 and the middle punching head 50 of the lower center punch 42 cooperate to form the inner slit 505 of the middle joint. And, in the fourth step, the middle punching head 50 of the upper outside punch 41 and the middle punching head 50 of the lower center punch 42 cooperate to form the outer slit 506 of the middle joint.

Thus, during creation of the sealless connection using the reduced force sealless connection mechanism of the present invention, no more than two slits of any of the joints are simultaneously punched. This reduces the operator force required to actuate the mechanism and decreases wear on the strapper components. The following examples illustrate the dramatic effect of the reduced force sealless connection mechanism of the present device as used in two prior art manual strappers, namely the SCM "Sealless Combination Tool for Steel Strapping," manufactured by ITW Signode of Glenview, Ill., and the SCMH "Sealless Combination Tool for Magnus® Strapping up to 0.75"×0.31," also manufactured by ITW Signode.

In the first example, a sample strap 0.75 inches wide and 0.025 inches thick (having an overlapped thickness of 0.050) was sealed using the SCM strapper. Using a prior art sealless connection mechanism, the handle load (the force experienced by the strapper operator when creating the sealless connection) was 48 pounds. Using the reduced force sealless connection mechanism of the present invention, the handle load was 25 pounds. This represents a 48 percent reduction in handle load.

In the second example, a sample strap 0.75 inches wide and 0.031 inches thick (having an overlapped thickness of 0.062) was sealed using the SCMH strapper. Using a prior art sealless connection mechanism, the handle load was 62 pounds. Using the reduced force sealless connection mechanism of the present invention, the handle load was 44 pounds. This represents a 29 percent reduction in handle load.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

What is claimed is:

1. A reduced force sealless connection mechanism for a strapper used to punch overlapping strapping material to create a sealless connection comprised of a plurality of slits, the reduced force sealless connection mechanism comprising:

an upper punch support;

a lower punch support;

at least two upper punches mounted on the upper punch support; and at least one lower punch mounted on the lower punch support;

wherein the at least two upper punches each include a plurality of punching heads;

wherein the at least one lower punch includes a plurality of punching heads designed to cooperate with the plurality of punching heads of the at least two upper punches;

wherein the plurality of punching heads of the at least two upper punches are of different heights relative to a top surface of the overlapping strapping material;

wherein the plurality of punching heads of the at least one lower punch are of different heights relative to a bottom surface of the overlapping strapping material;

wherein the upper punch support includes a step to create different heights between the at least two upper punches relative to the top surface of the overlapping strapping material; and wherein no more than two slits are simultaneously punched in the overlapping strapping material at one time.

2. The reduced force sealless connection mechanism of claim 1 wherein at least two upper punches comprise an upper inside punch and an upper outside punch.

3. The reduced force sealless connection mechanism of claim 2 wherein at least one lower punch comprises a lower center punch.

4. The reduced force sealless connection mechanism of claim 3 wherein the upper inside punch comprises a first upper inside punching head, a middle upper inside punching head, and a last upper inside punching head.

5. The reduced force sealless connection mechanism of claim 4 wherein the upper outside punch comprises a first upper outside punching head, a middle upper outside punching head, and a last upper outside punching head.

6. The reduced force sealless connection mechanism of claim 5 wherein the lower center punch comprises a first lower center punching head, a middle lower center punching head, and a last lower center punching head.

7. The reduced force sealless connection mechanism of claim 6 wherein the first upper inside punching head, the last upper inside punching head, the first upper outside punching head, and the last upper outside punching head all are the same height.

8. The reduced force sealless connection mechanism of claim 7 wherein the first lower center punching head and the last lower center punching head are the same height.

9. The reduced force sealless connection mechanism of claim 8 wherein the middle upper inside punching head and the middle upper outside punching head are shorter than the first upper inside punching head, the last upper inside punching head, the first upper outside punching head, and the last upper outside punching head.

10. The reduced force sealless connection mechanism of claim 9 wherein the middle lower center punching head is shorter than the first lower center punching head and the last lower center punching head.

11. The reduced force sealless connection mechanism of claim 10 wherein the upper outside punch is higher than the upper inside punch relative to the top surface of the overlapping strapping material.

12. The reduced force sealless connection mechanism of claim 11 wherein the upper punch support is movable and the lower punch support is fixed.

13. The reduced force sealless connection mechanism of claim 12 wherein the upper punch support is movable in a direction of the lower punch support.

14. The reduced force sealless connection mechanism of claim 13 wherein the upper punch support and lower punch support are designed to receive the overlapping strapping material therebetween.

15. The reduced force sealless connection mechanism of claim 14 wherein the first upper inside punching head and the first lower center punching head and the last upper inside punching head and the last lower center punching head are designed to simultaneously punch the strapping material in a first punching step;

wherein the first upper outside punching head and the first lower center punching head and the last upper outside punching head and the last lower center punching head are designed to simultaneously punch the strapping material in a second punching step;

wherein the middle upper inside punching head and the middle lower center punching head are designed to simultaneously punch the strapping material in a third punching step; and wherein the middle upper outside punching head and the middle lower center punching head are designed to simultaneously punch the strapping material in a fourth punching step.

16. The reduced force sealless connection mechanism of claim 1 wherein one of the at least two upper punches resides on one side of the step and the other of the at least two upper punches resides on the other side of the step.

17. A method for creating a reduced force sealless connection between overlapping strapping material, said method comprising the steps of:

providing a movable upper punch support having an upper inside punch and an upper outside punch, wherein the upper punch support is stepped to cause the upper inside punch to be lower than the upper outside punch relative a top surface of the overlapping strapping material;

providing a fixed lower punch support having a lower center punch;

providing a first upper inside punching head, a middle upper inside punching head, and a last upper inside punching head on the upper inside punch, wherein the middle upper inside punching head is shorter than the first upper inside punching head and the last upper inside punching head;

providing a first upper outside punching head, a middle upper outside punching head, and a last upper outside punching head on the upper outside punch, wherein the middle upper outside punching head is shorter than the first upper outside punching head and the last upper outside punching head;

providing a first lower center punching head, a middle lower center punching head, and a last lower center punching head on the lower center punch, wherein the middle lower center punching head is shorter than the first lower center punching head and the last lower center punching head;

moving the movable upper punch support in the direction of the fixed lower punch support to engage the overlapping strapping material therebetween;

providing a first punching step wherein the first upper inside punching head and the first lower center punching head and the last upper inside punching head and the last lower center punching head simultaneously punch the overlapping strapping material;

providing a second punching step wherein the first upper outside punching head and the first lower center punching head and the last upper outside punching head and the last lower center punching head simultaneously punch the overlapping strapping material;

providing a third punching step wherein the middle upper inside punching head and the middle lower center punching head simultaneously punch the overlapping strapping material; and providing a fourth punching step wherein the middle upper outside punching head and the middle lower center punching head simultaneously punch the overlapping strapping material.

* * * * *